US006435257B2

(12) United States Patent
Simkovich

(10) Patent No.: US 6,435,257 B2
(45) Date of Patent: Aug. 20, 2002

(54) BOTTOM POURING FULLY DENSE LONG INGOTS

(75) Inventor: Alex Simkovich, Ligonier, PA (US)

(73) Assignee: Concurrent Technologies Corporation, Johnstown, PA (US)

( * ) Notice: Subject to any disclaimer, the term of this patent is extended or adjusted under 35 U.S.C. 154(b) by 0 days.

(21) Appl. No.: 09/809,451

(22) Filed: Mar. 15, 2001

Related U.S. Application Data

(62) Division of application No. 09/156,835, filed on Sep. 18, 1998.

(60) Provisional application No. 60/059,393, filed on Sep. 19, 1997.

(51) Int. Cl.[7] ..... B22D 7/06

(52) U.S. Cl. ..... 164/122.1; 164/123; 164/121; 164/133; 249/174

(58) Field of Search ..... 164/122.1, 338.1, 164/127, 371, 133, 337, 121, 123, 124; 249/174

(56) References Cited

U.S. PATENT DOCUMENTS

| | | | | |
|---|---|---|---|---|
| 3,598,172 A | * | 8/1971 | Copley et al. | 164/127 |
| 3,672,432 A | * | 6/1972 | Widdowson et al. | 164/119 |
| 4,512,544 A | * | 4/1985 | Eckenrode et al. | 249/109 |

* cited by examiner

*Primary Examiner*—Kuang Y. Lin
*Assistant Examiner*—I. H. Lin
(74) *Attorney, Agent, or Firm*—Buchanan Ingersoll, P.C.

(57) ABSTRACT

Fully dense long ingots are produced by the bottom pouring method and apparatus of the present invention. A solidification sequence is achieved which is conducive to eliminating solidification shrinkage and piping. The set-up of the bottom poured ingot molds facilitates a solidification sequence starting from the top and then down the ingot mold and then up the down pour pipe.

15 Claims, 5 Drawing Sheets

BOTTOM POURING FULLY DENSE LONG INGOTS

This application claims the benefit of U.S. Provisional Application No. 60/059,393, filed Sep 19, 1997 and is a divisional of U.S. Application No. 09/156,835, filed Sep. 18, 1998.

BACKGROUND

The special alloys industry, requires a high quality, fully dense billet for rolling various product forms. Presently high quality specialty alloy bars are generally made by hot rolling round or square billets four or five inches in diameter to finished bars in a size range of tow inches or less. Such billets are generally produced for the specialty alloys industry by continuous casting, conventional static cast ingots, and VAR (vacuum arc remelting)/ESR (electroslag remelting) processed remelt ingots.

Continuous casting is the only method currently utilized that is capable of converting the liquid steel directly into solid semifinished forms. Continuous casting skips the intermediate step of forging the ingots for rolling mill feed stock and has higher yield. The disadvantages of continuous casting include the high cost of machinery and the requirement of large tonnage of the product. Many specialty mills cannot afford the large capital outlay required to purchase continuous casting equipment. Continuous casting is also not appropriate for all alloys because of macrosegregation problems.

The conventional static cast and VAR/ESR remelt ingot processes each include the added cost of open die or rotary forging to form the billet for feed stock. Ingot cross sectional dimensions are limited under static casting due to macrosegregation. Alloy macrosegregation in ingots can be greatly reduced using VAR/ESR remelting but at an added cost.

A bottom pouring process of casting long ingots could alleviate the need for open die or rotary forging by producing a billet suitable for feed stock to a rolling mill. Bottom pouring consists of pouring liquid alloy into a vertical cast iron downpour pipe or "trumpet". The liquid alloy then flows out from the bottom of the downpour pipe and into horizontal runners attached to the base of the downpour pipe. The liquid alloy travels through the horizontal runners and flows into vertical cast iron ingot molds where the liquid completely fills the void within the mold. Such a bottom-pour set-up has the advantage of eliminating the turbulent splashing associated with normal top pouring set-ups. By eliminating turbulent splashing the bottom-pour set-up results in a smoother ingot surface.

The disadvantage to conventional bottom-pouring is discontinuous solidification that results in piping. Piping is a cavity usually found in the middle of the ingot, which results from the metal contracting as it cools in the mold. Shrinkage pipes are usually an incurable defect because the cavity formed by the pipe may be oxidized and thus the pipes will not weld shut during the rolling of the ingot. To cure the defect a portion of the ingot containing the shrinkage pipes must be cropped and returned to the electric furnace as scrap. If the defect is not cropped the ingot will produce a weakened finished steel product.

During casting, under the conventional bottom-pouring process, the horizontal runners and center down-pour usually cool too quickly. Such cooling deprives the bottom ingot portion of the liquid metal needed to fill any voids created in the solidifying upper portion of the ingot mold. As the top cools the metal contracts and voids (shrinkage pipes) form within the ingot and remain unfilled as new molten metal is prevented from entering the ingot mold. Shrinkage pipes are undesirable defects which often interfere with subsequent hot forming or remelting operations. To minimize solidification shrinkage, exothermic hot tops have been fitted into the top of the ingot molds to reverse the direction of solidification, unfortunately hot tops have met with little success. A method is needed that is capable of altering to normal solidification pattern of bottom-pouring so that fully dense ingots for feed stock can be cast.

SUMMARY

An object of the present invention is to facilitate a solidification sequence conducive to eliminating solidification shrinkage and piping. Another object of the present invention is to form fully dense long ingots using an innovative set-up of bottom poured ingot molds.

The present invention'solidification sequence begins with the top of the ingots solidifying first. The solidification process then progressively descends down along the length of the side ingots until the ingots connect with lateral runners. The lateral runners feed the side ingot with molten metal. Solidification then proceeds from the runner to the center vertical down pour pipe, which originally received the molten metal. The metal then solidifies from the bottom of the down pour pipe to the top of the pipe. Through this process fully dense long ingots can be formed.

DESCRIPTION OF THE DRAWINGS

These and other features, aspects and advantages of the present invention will become better understood with regard to the following description, and accompanying drawings where.

DETAILED DESCRIPTION

Figure 1:
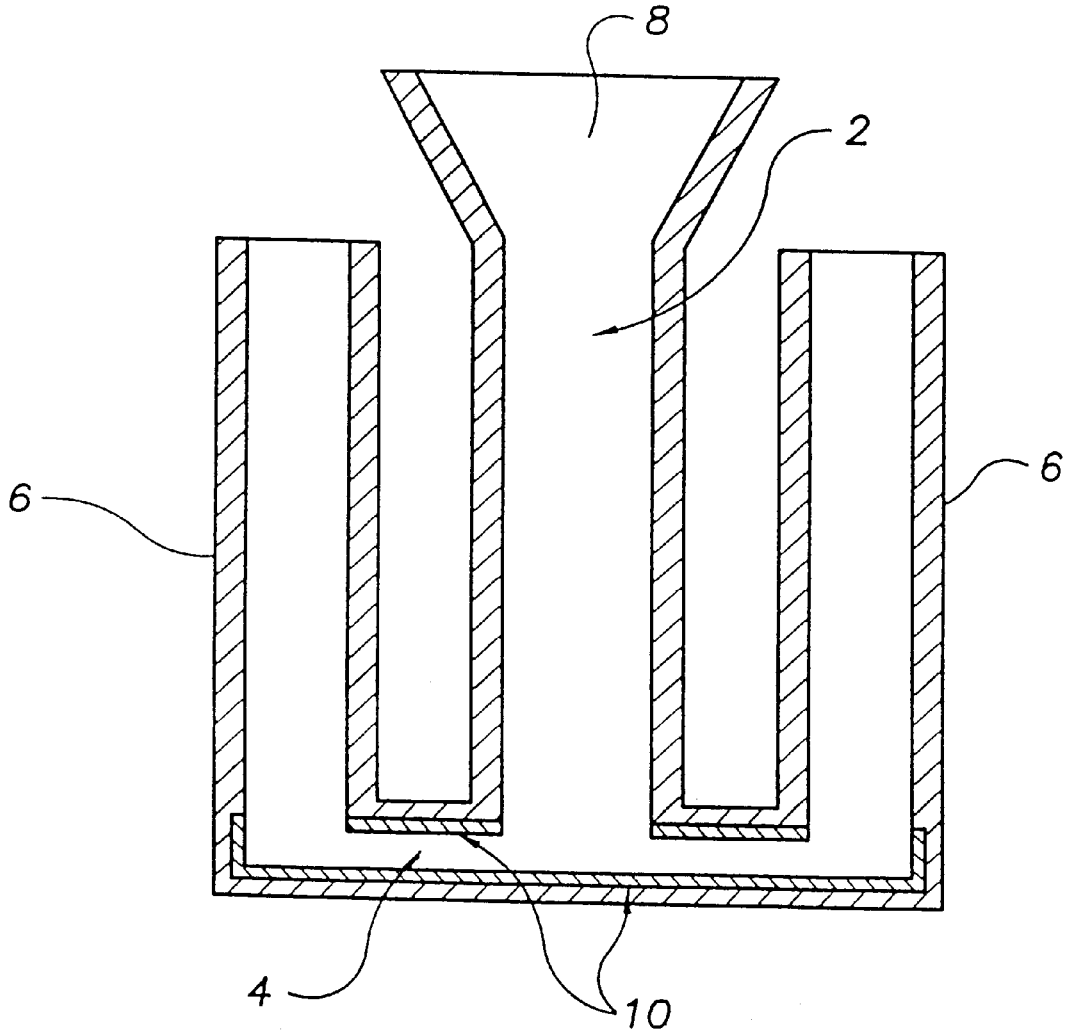
FIG. 1 shows a cutaway view of a mold setup for a bottom poured ingots apparatus.

As illustrated in FIG. 1, the present invention includes a central vertical down pour pipe 2 connected at the bottom by lateral runners 4. At the outer ends of the runners 4 are vertical side ingot molds 6 extending parallel and in spaced relation to the vertical down pour pipe 2. The present invention can be operated under a vacuum or at atmosphere.

The central down pour pipe 2 is preferably configured out of cast iron with a shell mold design to facilitate mold stripping operations. Cast iron is preferred, but any other material suitable for casting liquid metals may be used. The shell mold design forms a cavity within the center down pour pipe 2 by preferably joining at least two pieces, which are held together by metal clamps 12. The down pour pipe 2 may also be used as a mold for forming an ingot.

The introduction of molten metal into the down pour pipe 2 is aided by a pour cup 8 formed from the upper portion of the down pour pipe 2. The pour cup 8 is preferably configured as a funnel, with a wide end for receiving molten metal and a small end integral with and having the same diameter as the down pour pipe 2. The bottom portion of the down pour pipe 2 is connected to lateral runners 4. The down pour pipe 2 is connected to the lateral runners 4 so that liquid metal may flow from the down pour pipe 2 and into the lateral runners 4.

Figure 2:
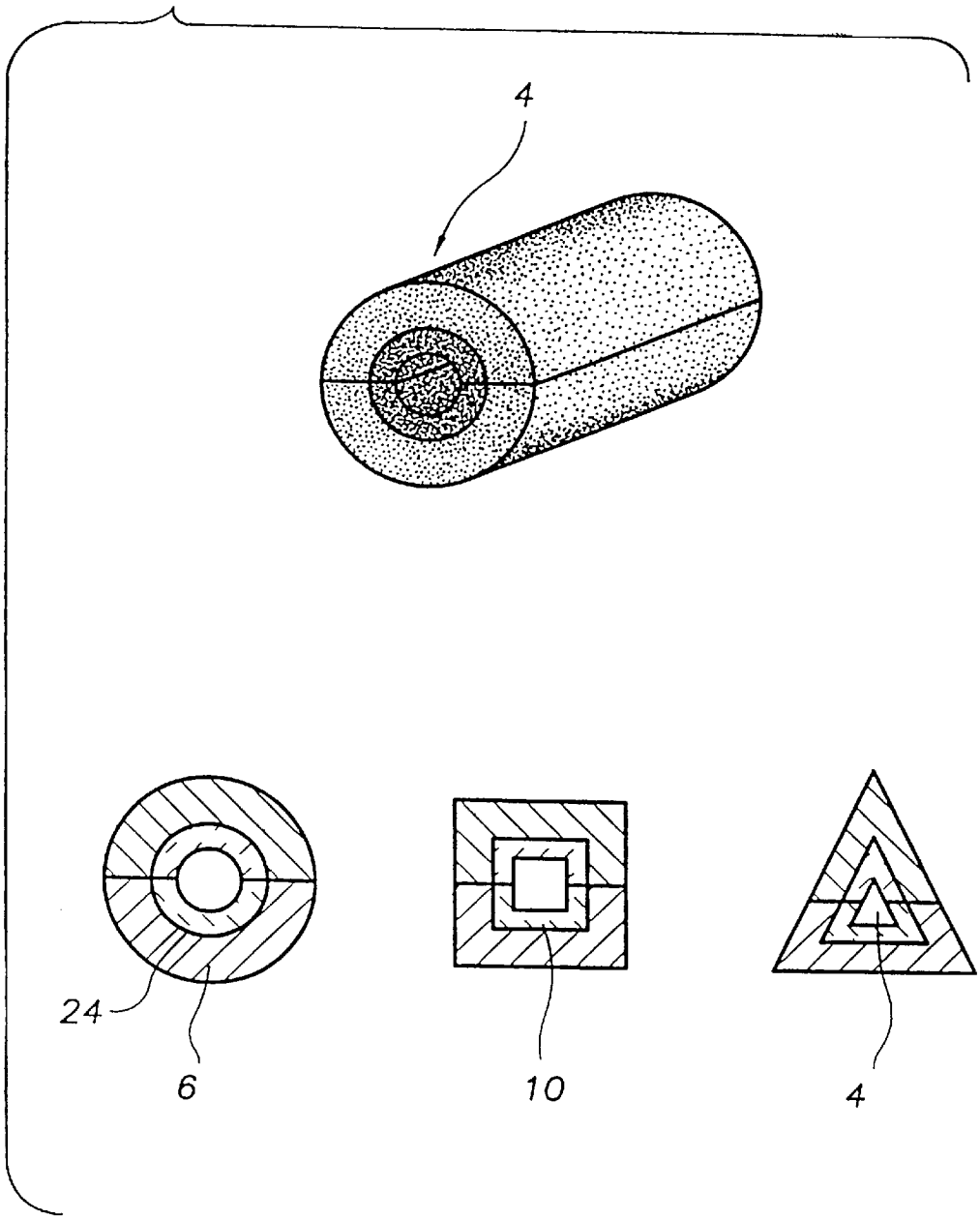
FIG. 2 illustrates different setups for lateral runners, including a circular, square and triangular configuration; also illustrated is a ceramic insulating tube.

The lateral runners 4 are configured out of cast iron with a shell mold design. The interior walls 24 of the lateral runners 4 form a cavity. A ceramic insulating tube 10 is fitted securely to the interior walls 24 of each of the runners' 4 cast iron shells. The ceramic tube 10 insulator is preferably made of a ceramic oxide selected from the group consisting essentially of alumina, silica, and magnesia. The ceramic may also be either boron carbide or silicon carbide. Molten metal flows through the ceramic tube 10. The ceramic tube 10 aids in preventing heat from being transferred from the molten metal. As illustrated in FIG. 2, the runners 4 may be dimensionally configured in appropriate shapes such as circles squares, or triangles. Runners 4, dimensionally configured as triangles, have the advantage of being able to entrap ceramic particles that may break free of the insulation. Ceramic particles freed from the runners 4 and then mixed with the molten metal add unwanted inclusions to the metal ingots formed in the molds 6. The apex of the triangularly shaped runner 4 is able to capture the majority of the particles and prevent them from reaching the ingot mold 6. Filters can also be positioned within the runners to prevent ceramic particles from entering the ingot molds 6.

Figure 3:
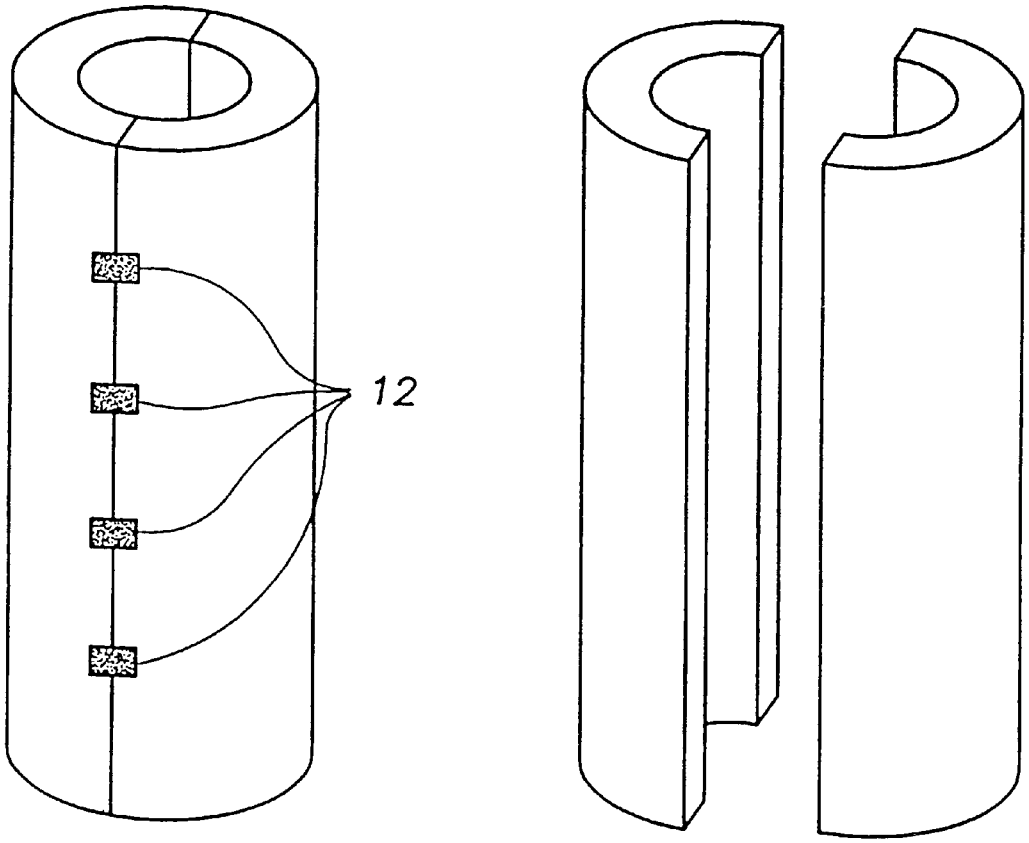
FIG. 3 shows a split mold configuration including clamps.

The ingot molds 6 preferably have a split mold configuration in order to facilitate the mold stripping operation. As illustrated in FIG. 3, the split molds are preferably fastened together by metal clamps 12 and are generally formed from cast iron. Generally, a plurality of side ingot mold 6 elements are clustered around the down pour pipe 2 so that numerous ingots may be cast simultaneously. The ingot molds 6 are connected to the down pour pipe 2 by the lateral runners 4. The bottom of each ingot mold 6 is connected to a lateral runner 4 and into the ingot mold 6. Molten metal is supplied to the bottom of the ingot mold 6 and fills the mold from the bottom to the top. The ingot molds 6 can form the molten metal into ingots having any shape but cylindrical or cubical are most common.

Figure 5:
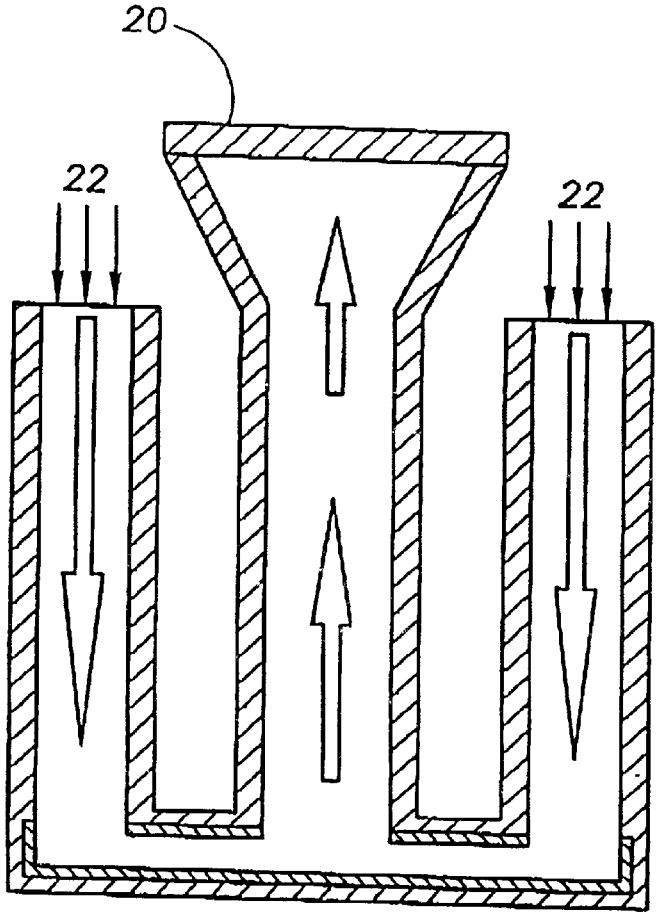
FIG. 5 schematically shows the preferred direction of the solidification, the cap and compressed air being applied to the ingot molds.
Figure 6:
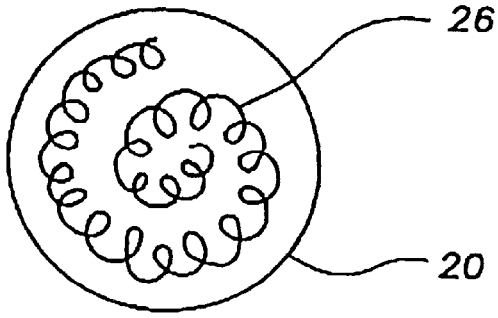
FIG. 6 illustrates the cap and the cap heating element which rest atop the pour cup.

The preferred ingot solidification sequence for the present invention, as illustrated in FIG. 5, is from the top of the ingot mold 6 then down the mold, to the runner 4, and last up to the top of the down pour pipe 2. Thus, the first place to solidify will be the top of the ingot molds 6 and the last place to solidify will be the top of the down pour pipe 2. Such a pattern is designed to prevent piping or voids from being formed within the solidified ingot.

Figure 4:
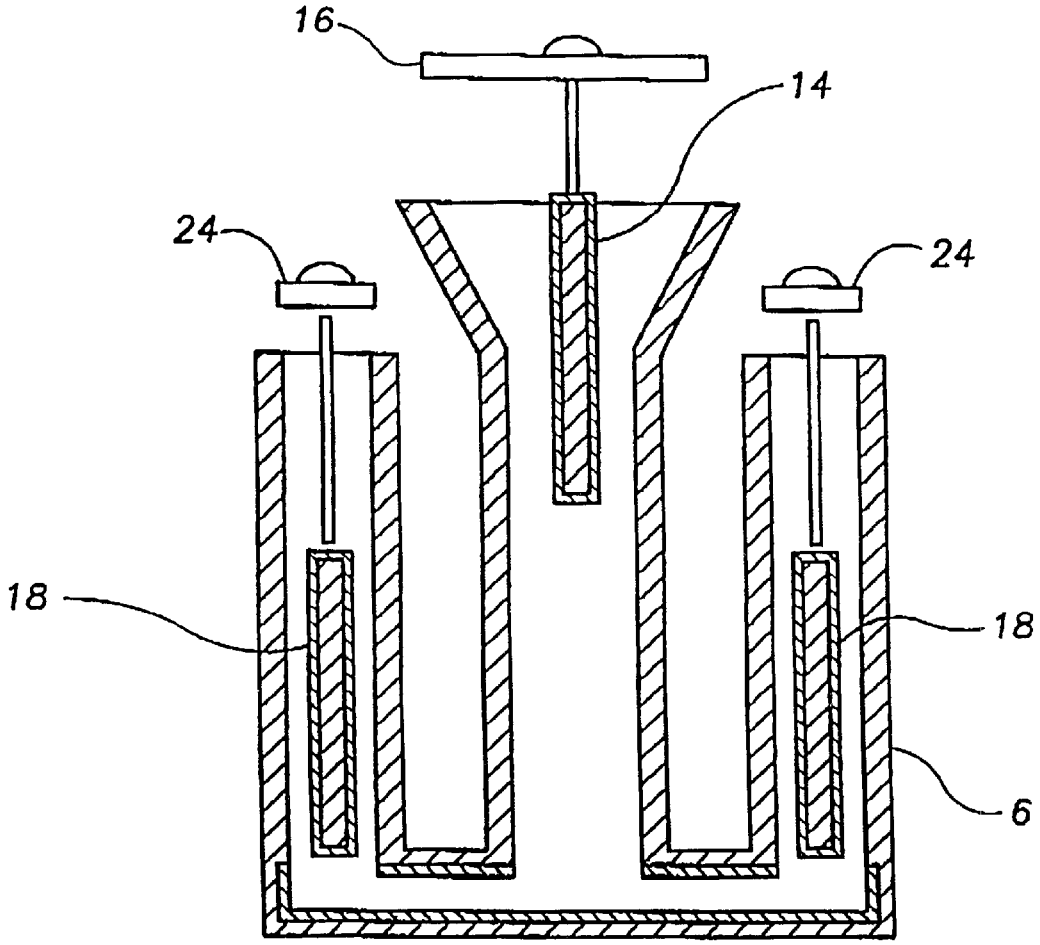
FIG. 4 illustrates a mold heating setup, including heating elements for down pour tube and ingot side molds.

As illustrated in FIG. 4, the central vertical down pour pipe 2 is heated prior to filling in order to aid in establishing the preferred solidification pattern of the present invention. A down pour pipe heating element 14 is lowered into the down pour pipe 2 cavity to heat the surrounding walls of the pipe 2. Preferably, only the middle portion to the upper portion of the down pour pipe 2 is heated by the element 14. An example of a possible down pour pipe heating 14 element is a quartz rod radiation heater. The heater 14 is slowly lowered into the pipe 2 as it heats the walls of the pipe 2. The heating element 14 may have a pour cup heat shield 16 at the upper end of the element so as to direct the heat downward. The pour cup heat shield 16 preferably rests upon the rim of the pour cup 8 once the element has been fully inserted. Other heating elements, such as natural gas or liquid hydrocarbon may also be used so long as the element is capable of being lowered into the down pour pipe 2. The down pour pipe heating element 14 preferably preheats the down pour pipe 2 to a temperature that is below the particular metal liquidus temperature of the metal being formed.

The ingot molds 6 are heated by separate individual mold heating elements 18. Like the vertical down pour pipe 2, the ingot molds 6 are heated prior to the filling of the molds 6. A mold heating element 18 is lowered into the open top of the ingot mold 6 and down into the mold 6 cavity. Preferably only the lower to middle portion of the mold 6 is preheated by the mold heating element 18. The mold heating element 18 can have the same configuration as that used for the down pour pipe heating elements 14, although alternative configurations are acceptable. The mold heating element 18 may have an ingot mold heat shield 24 at the upper end of the element so as to direct the heat downward. The ingot mold heat shield 24 preferably rests upon the rim of the side ingot molds 6 once the elements have been fully inserted. The mold heating elements 18 for the ingot molds 6 preferably only reheat the molds 6 to a temperature that is below the particular metal liquidus temperature of the metal being formed.

Once the heating elements (14 and 18) have been removed from the down pour pipe and ingot molds, molten metal can be poured into the center down pour pipe 2. Once the molten metal reaches the bottom of the down pour pipe 2 it is dispersed into the individual lateral runners 4 connected at the base of the down pour pipe 2. The lateral runners 4 then transfer the molten metal to the base of the ingot molds 6. The ingot molds 6 are filled from the base of the mold to the top, in order to eliminate splashing and to promote a smoother ingot surface.

Once the present invention is filled with molten material, a cap 20, as illustrated in FIG. 5, may be fitted upon the wide end of the pour cup 8 rim. If a cup 8 has not been formed, the cap 20 may be fitted upon the rim of the open top of the down pour pipe 2. The cap 20 may be made of any material capable of withstanding the high temperature of the molten metal and should be able to provide an insulating barrier. The cap 20 may also be equipped with electric heating elements 26 to provide additional heat to the top of the metal in the pour cup. The cap 20 functions to retard heat loss and to aid in ensuring that the molten metal located at the top of the down pour pipe 2 will be the last molten metal to solidify within the bottom pouring apparatus. Also, to aid in the preferred solidification sequence of the present invention, compressed air 22 may be blown on the open top of the ingot mold 6. The compressed air 22 accelerates the solidification of the exposed molten metal in the top portion of the ingot mold 6. Thus the first molten metal to solidify will be the metal located at the top of the ingot molds 6.

What is claimed:

1. In a bottom pouring ingot mold having a down pour pipe with an upper portion, a middle portion, and a lower portion, one or more ingot molds, each of said one or more ingot molds with an upper portion, a middle portion, and a lower portion, and one or more runners connecting said down pour pipe to each of said one or more ingot molds, a method for producing ingots comprising the steps of:

inserting a first heating element into said down pour pipe for the purpose of pre-heating said upper and middle portions of said down pour pipe;

inserting a second heating element into each of said one or more ingot molds, for the purpose of pre-heating said lower and middle portions of each of said ingot molds;

removing said first heating element from said down pour pipe and said second heating element from each of said ingot molds; and pouring molten metal into said down pour pipe, such that said molten metal flows into said one or more ingot molds via said one or more runners.

2. The method of claim 1 further comprising the step of cooling said upper portion of each of said one or more ingot molds to accelerate solidification of said molten metal in said upper portion of said ingot mold.

3. The method of claim 2 wherein said upper portion of each of said ingot molds is cooled by blowing compressed air thereover.

4. The method of claim 1 wherein said upper and middle portions of said down pour pipe are pre-heated to a temperature below the liquidus temperature of said molten metal.

5. The method of claim 1 wherein said lower and middle portions of each of said ingot molds are pre-heated to a temperature below the liquidus temperature of said molten metal.

6. The method of claim 1 further comprising the step of covering said down pour pipe after said molten metal has been poured therein, to retard the solidification of said molten metal near said top portion of said down pour pipe.

7. The method of claim 6 wherein said down pour pipe is covered with an insulating cap.

8. The method of claim 7 further comprising the step of applying a third heating element to said top portion of said down pour pipe, thereby further retarding the solidification of said molten metal near said top portion of said down pour pipe.

9. The method of claim 1 wherein said first and said one or more second heating elements are quartz rod radiation heaters.

10. The method of claim 8 wherein said third heating element is a resistive electric heater.

11. The method of claim 1 wherein said first heating element is fitted with a cap which covers said down pour pipe to retain the heat from said heating elements therein.

12. The method of claim 1 wherein said one or more second heating elements are fitted with a cap which covers said respective ingot molds, to retain the heat from said heating elements therein.

13. In a bottom pouring ingot mold having a down pour pipe with an upper portion, a middle portion, and a lower portion, an ingot mold, with an upper portion, a middle portion, and a lower portion, and a runner connecting said down pour pipe to said ingot mold, a method for producing a metal ingot comprising the steps of:

inserting a first heating element into said down pour pipe for the purpose of pre-heating said upper and middle portions of said down pour pipe to a temperature below the liquidus temperature of said molten metal;

inserting a second heating element into said ingot mold, for the purpose of pre-heating said lower and middle portions of said ingot mold to a temperature below the liquidus temperature of said molten metal;

removing said first heating element from said down pour pipe and said second heating element from said ingot mold; and pouring molten metal into said down pour pipe, such that said molten metal flows into said ingot mold via said runner.

14. The method of claim 13 further comprising the step of cooling said upper portion of said ingot mold by blowing compressed air thereover to accelerate solidification of said molten metal therein.

15. The method of claim 13 further comprising the step of providing a cap to cover said down pour pipe after said molten metal has been poured therein, said cap having a third heating element therewith, to retard the solidification of said molten metal near said top portion of said down pour pipe.

* * * * *

UNITED STATES PATENT AND TRADEMARK OFFICE

CERTIFICATE OF CORRECTION

PATENT NO. : 6,435,257 B2
DATED : August 20, 2002
INVENTOR(S) : Kuang-O Yu and Alex Simkovich It is certified that error appears in the above-identified patent and that said Letters Patent is hereby corrected as shown below:

Title page,
Item [75], Inventor, before "Alex Simkovich", please insert -- Kuang-O Yu, Highland Height, OH --.
Item [12], United States Patent, delete "Simkovich" and insert -- Yu --.

Signed and Sealed this

Twenty-fourth Day of December, 2002

JAMES E. ROGAN
*Director of the United States Patent and Trademark Office*